US011885551B2

(12) United States Patent
Mitchell

(10) Patent No.: US 11,885,551 B2
(45) Date of Patent: Jan. 30, 2024

(54) DEFROSTER FOR A DIRECT COOL ICEMAKER

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 13 days.

(21) Appl. No.: 17/326,535

(22) Filed: May 21, 2021

(65) Prior Publication Data

US 2022/0373243 A1 Nov. 24, 2022

(51) Int. Cl.
*F25C 5/08* (2006.01)

(52) U.S. Cl.
CPC ..... *F25C 5/08* (2013.01)

(58) Field of Classification Search
CPC ..... F25C 5/08
See application file for complete search history.

(56) References Cited

U.S. PATENT DOCUMENTS 2,024,612 A * 12/1935 Sulzberger ..... F25D 21/08 62/301
4,923,494 A * 5/1990 Karlovits ..... F25C 1/04 62/73
9,448,003 B2 9/2016 Jeong
9,689,600 B2 6/2017 Jeong
2011/0162406 A1* 7/2011 Shin ..... F25C 1/24 62/340

FOREIGN PATENT DOCUMENTS

JP 2007057198 A * 3/2007
KR 2006060449 A 6/2006
KR 2018117790 A * 10/2018 ..... F25C 1/24
KR 2018117790 A 10/2018

OTHER PUBLICATIONS

Translated_Dong (Year: 2018).*
Translated_Toshiki (Year: 2007).*

* cited by examiner

*Primary Examiner* — Elizabeth J Martin
*Assistant Examiner* — Samba Nmn Gaye
(74) *Attorney, Agent, or Firm* — Dority & Manning, P.A.

(57) ABSTRACT

An icemaker assembly includes a mold body defining a plurality of cavities. A working fluid line is directly attached to the mold body, and a drain duct is disposed below the mold body. A defrost heating element is positioned below the mold body and within the drain duct. The defrost heating element is spaced from the mold body, and the defrost heating element is operable to melt frost on the mold body with radiant heat from the defrost heating element. A related appliance is also provided.

17 Claims, 4 Drawing Sheets

DEFROSTER FOR A DIRECT COOL ICEMAKER

FIELD OF THE INVENTION

The present disclosure relates generally to toggle handles for appliances.

BACKGROUND OF THE INVENTION

Certain refrigerator appliance include an icemaker for generating ice cubes. Some icemakers, referred to as "direct cool" icemakers, have a mold body that is cooled via conductive heat transfer to a refrigerant loop coupled to the mold body. One advantage of direct cool icemakers is the ability to form ice more quickly than air cooled ice makers. However, moisture from unfrozen water in the mold body can humidify air around the icemaker, and the moisture can collect as frost on the mold body and refrigerant loop. Over time, the frost can negatively affect operation of the direct cool icemaker.

Known direct cool icemakers utilize a resistance heating element on the mold body to harvest ice cubes from the mold body and also melt the frost on the mold body. One problem in known direct cool icemakers is that frost that is unconnected to the mold body is not completely melted during operation of the resistance heating element. Each harvest leaves some ice around the direct cool icemakers that accumulates over time to the point where the icemaker no longer makes ice.

BRIEF DESCRIPTION OF THE INVENTION

The present subject matter provides a direct cool icemaker with a defrost heating element that is not attached to a mold body but is placed within a drain duct. The defrost heating element may be activated on each ice harvest, and the defrost heating element may generate radiant heat that melts frost around and/or on the mold body. By melting the frost from outside the mold body and not relying upon conduction, the frost around the mold body may be completely melted, e.g., rather than partially melted as with conventional defrosting that relies upon conductive heat transfer from the mold body. Aspects and advantages of the invention will be set forth in part in the following description, or may be obvious from the description, or may be learned through practice of the invention.

One example aspect of the present disclosure is directed to an icemaker assembly that includes a mold body defining a plurality of cavities. A working fluid line is directly attached to the mold body such that at least a portion of the working fluid line contacts the mold body. A drain duct is disposed below the mold body. A defrost heating element is positioned below the mold body and within the drain duct. The defrost heating element is spaced from the mold body. The defrost heating element is operable to melt frost on the mold body with radiant heat from the defrost heating element.

In example embodiments, the icemaker assembly may be disposed within a cabinet of an appliance.

Variations and modifications may be made to these example embodiments of the present disclosure. These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
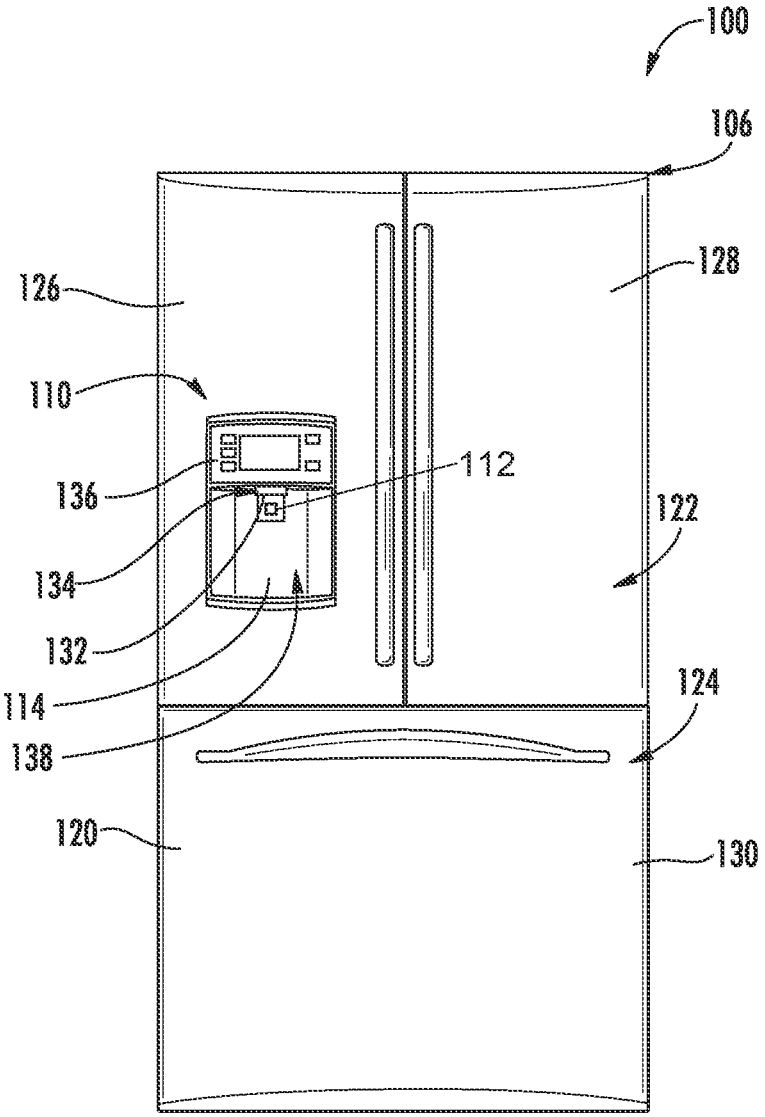
FIG. 1 provides a front, elevation view of a refrigerator appliance according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Example aspects of the present disclosure are directed to an icemaker assembly with a defrost heating element that is positioned below the mold body and within the drain duct. The defrost heating element is spaced from the mold body and is operable to melt frost on the mold body with radiant heat from the defrost heating element. A working fluid line is directly attached to the mold body such that at least a portion of the working fluid line contacts the mold body. During operation, the mold body rejects heat to working fluid within the working fluid line to freeze liquid water within the mold body and thus form ice. However, moisture from unfrozen water in the mold body humidifies air around the mold body, and the moisture from the air freezes on the mold body and other elements of the icemaker to form frost buildup. The radiant heat from the defrost heating element advantageously melts the frost from outside the mold body and does not rely upon conduction. Thus, the defrost heating element may completely melt built up frost. In contrast, the defrosting mechanism in known direct cool icemakers rely upon conduction from the mold body to melt frost but frost that is unconnected to the mold body frequently is not completely melted in the known direct cool icemakers, and each harvest leaves some ice around the known direct cool icemakers that accumulates over time to the point where the icemaker no longer makes ice. Thus, the icemaker assembly of the present disclosure advantageously operates with significantly reduced or delayed frost build up over time.

Referring now to the figures, FIG. 1 depicts a front view of an example embodiment of a refrigerator appliance 100. Refrigerator appliance 100 includes a cabinet or housing 120 defining an upper fresh food chamber 122 and a lower freezer chamber 124 arranged below the fresh food chamber 122. As such, refrigerator appliance 100 is generally referred to as a bottom-mount refrigerator appliance. In the exemplary embodiment, housing 120 also defines a mechanical compartment (not shown) for receipt of a sealed cooling system. Using the teachings disclosed herein, one of skill in the art will understand that the present invention may be used with other types of refrigerator appliances (e.g., side-by-sides or top-mounts). Consequently, the description set forth herein is for illustrative purposes only and is not intended to limit the invention to any particular style of refrigerator appliance or arrangement of chilled chambers.

Refrigerator doors 126, 128 are rotatably hinged to an edge of housing 120 for accessing fresh food compartment 122. A freezer door 130 is arranged below refrigerator doors 126, 128 for accessing freezer chamber 124. In the exemplary embodiment, freezer door 130 is coupled to a freezer drawer (not shown) slidably mounted within freezer chamber 124.

Refrigerator appliance 100 includes a dispensing assembly 110 for dispensing liquid water and ice. Dispensing assembly 110 includes a dispenser 114 positioned on an exterior portion of refrigerator appliance 100. Dispenser 114 includes a discharging outlet 134 for accessing ice and liquid water. Dispensing assembly 110 further includes a sensor 112 positioned on discharging outlet 134. As will be described in more detail below, sensor 112 may be configured to detect a presence of a container positioned within dispensing assembly 110, and to detect the top lip of the container. A user interface panel 136 is provided for controlling the mode of operation. For example, user interface panel 136 includes a water dispensing button (not labeled) and an ice-dispensing button (not labeled) for selecting a desired mode of operation such as crushed, non-crushed ice, or liquid water, etc.

Discharging outlet 134 is an external part of dispenser 114, and is mounted in a dispensing recess or recessed portion 138 defined in an outside surface of refrigerator door 126. Recessed portion 138 is positioned at a predetermined elevation convenient for a user to access ice or liquid water and enabling the user to access ice or liquid water without the need to bend-over and without the need to access freezer chamber 124. In the exemplary embodiment, recessed portion 138 is positioned at a level that approximates the chest level of a user.

Operation of the refrigerator appliance 100 is regulated by a controller (not shown) that is operatively coupled to user interface panel 136 and/or sensor 112. Panel 136 provides selections for user manipulation of the operation of refrigerator appliance 100 such as e.g., selections between whole or crushed ice, chilled liquid water, and/or other options. In response to user manipulation of the user interface panel 136, the controller operates various components of the refrigerator appliance 100. The controller may be positioned in a variety of locations throughout refrigerator appliance 100. In the illustrated embodiment shown in FIG. 1, the controller is located within beneath the user interface panel 136 on door 126. In such an embodiment, input/output ("I/O") signals may be routed between controller and various operational components of refrigerator appliance 100. In one exemplary embodiment, the user interface panel 136 may represent a general purpose I/O ("GPIO") device or functional block. In another exemplary embodiment, the user interface 136 may include input components, such as one or more of a variety of electrical, mechanical or electromechanical input devices including rotary dials, push buttons, and touch pads. The user interface 136 may be in communication with the controller via one or more signal lines or shared communication busses.

Figure 2:
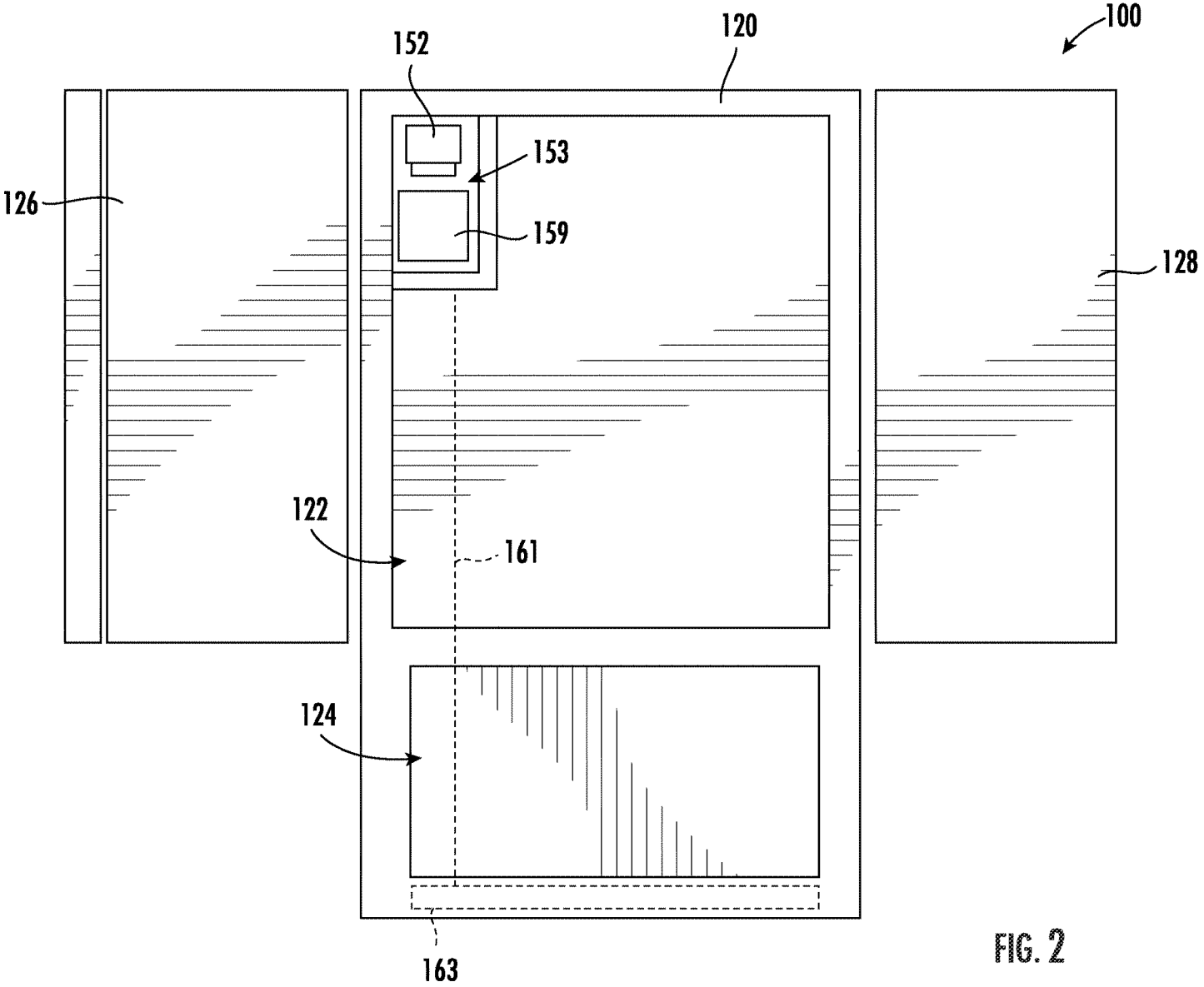
FIG. 2 is a schematic view of the example refrigerator appliance of FIG. 1.

FIG. 2 is a schematic view of certain components of refrigerator appliance 100. As shown in FIG. 2, cabinet 120 defines fresh food chamber 122 and freezer chamber 124. Within fresh food chamber 122, refrigerator appliance 100 may include an icemaker assembly 152 within an icemaking chamber 153. In certain example embodiments, icemaking chamber 153 may be cooled by an evaporator/working fluid line on icemaker assembly 152. Thus, icemaker assembly 152 may be a "direct cool" icemaker and is not air cooled to below a freezing point, in certain example embodiments.

Ice cubes made in icemaker assembly 152 drop into an ice bucket 159 for storage, and then through dispenser 114 when desired, as described above. Ice bucket 159 may be fixed in place or removable, as desired. Ice bucket 159 may be maintained at the temperature below freezing. For example, as noted above, icemaker assembly 200 may be cooled by an evaporator/working fluid line on icemaker assembly 152. Thus, icemaker assembly 200 may cool ice bucket 159 in order to maintain ice therein at the temperature below freezing. A drain line 161 is provided at the bottom of ice bucket 159 to remove any potential liquid water runoff Drain line 161 may lead to an evaporation pan 163, as shown.

Figure 3:
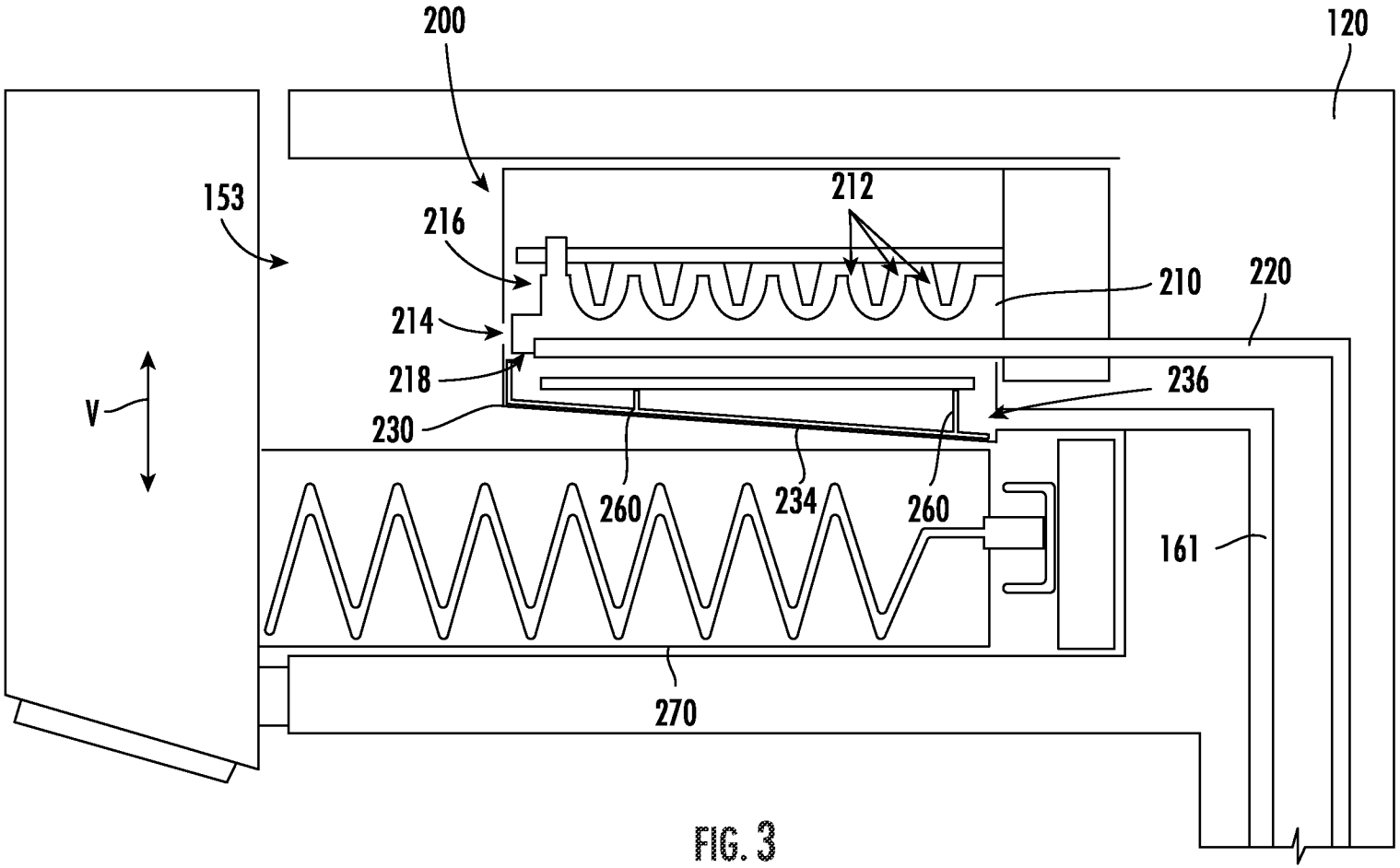
FIG. 3 is a side schematic view of an icemaker assembly according to an example embodiment of the present disclosure.
Figure 4:
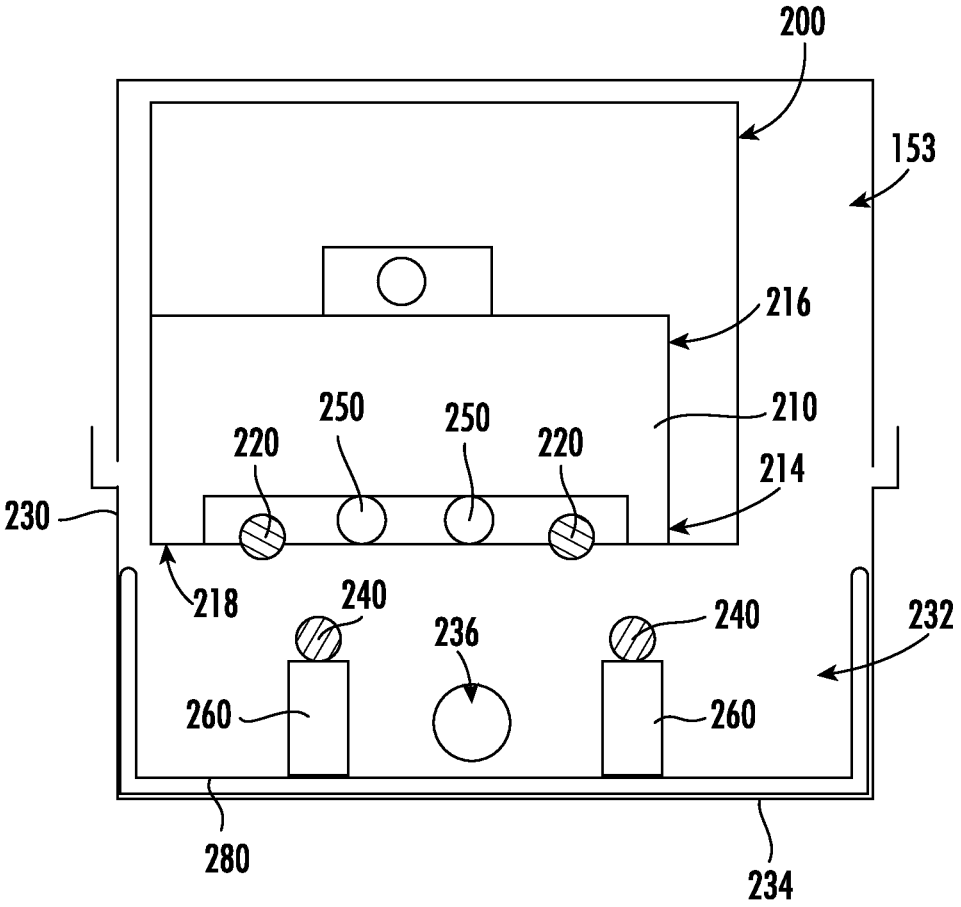
FIG. 4 is a front schematic view of the example icemaker assembly of FIG. 3.

FIGS. 3 and 4 shown an icemaker assembly 200 according to an example embodiment of the present disclosure. Icemaker assembly 200 may be used in or with any suitable appliance. For example, icemaker assembly 200 may be used in or with refrigerator appliance 100, e.g., as icemaker assembly 152. Thus, icemaker assembly 200 is described in greater detail below in the context of refrigerator appliance 100. However, it will be understood that icemaker assembly 200 may be used in or with a side-by-side refrigerator appliance, a stand-alone icemaker appliance, etc. in alternative example embodiments. As discussed in greater detail below, icemaker assembly 200 includes features that assist with defrosting icemaker assembly 200, e.g., more completely than known icemakers.

Icemaker assembly 200 includes a mold body 210 defining a plurality of cavities 212. Cavities 212 may be filled with liquid water and may be chilled to form ice cubes by freezing the liquid water within cavities. Cavities 212 may be shaped to form a desired ice cube shaper, e.g., crescent, cubic, etc. A working fluid line 220 is directly attached to mold body 210. Thus, at least a portion of working fluid line 220 contacts mold body 210. For example, working fluid line 220 may be attached to mold body 210 at a bottom portion 214 of mold body 210, and the top of working fluid line 220 may contact bottom portion 214 of mold body 210. Moreover, cavities 212 may be open and face upwardly at a top portion 216 of mold body 210, and working fluid line 220 may be clipped, soldered, adhered, fastened, etc. to mold body 210 opposite cavities 212 at bottom portion 214 of mold body 210. Working fluid line 220 may be a copper tube, an aluminum tube, etc. in certain example embodiments.

During operation of an associated sealed system (not shown), refrigerant or another working fluid, such as a mixture of glycol and water, may flow through working fluid line 220, and mold body 210 may reject heat to the working fluid flowing through working fluid line 220. Thus, mold body 210 may be chilled to less than the freezing temperature of water, and liquid water within cavities 212 may reject heat to mold body 210 until ice cubes form within cavities 212. In particular, because working fluid line 220 contacts mold body 210, conductive heat transfer between working fluid line 220 and mold body 210 may facilitate heat transfer from liquid water within cavities 212 to working fluid flowing through working fluid line 220. Air around mold body 210 may have a temperature greater than the freezing temperature of water during operation of the associated sealed system and ice formation within mold body 210. Thus, icemaker assembly 200 may be referred to as a "direct cool" icemaker, e.g., in contrast to an air-cooled icemaker that requires air around mold body 210 to chill mold body 210 to a temperature less than the freezing temperature of water during ice formation within mold body 210.

Icemaker assembly 200 also includes a drain duct 230 disposed below mold body 210. Drain duct 230 defines a drain cavity 232. Drain duct 230 is positioned to collect liquid water runoff from mold body 210. For example, moisture from unfrozen water in mold body 210 may humidify air around mold body 210, and the moisture from the air may freeze on mold body 210 and other elements of icemaker assembly 200 to form frost buildup. As another example, water from ice in an ice bin 270 may sublimate from the surface of the ice, migrate to mold body 210, and form frost on mold body 210. During a defrost operation, which is described in greater detail below, the frost is melted, and the liquid runoff from the melting frost may flow downwardly into drain duct 230. A bottom wall 234 of drain duct 230 may slope downwardly to an outlet 236, and outlet 236 of drain duct 230 may be connected to drain line 161. Thus, the liquid water in drain duct 230 may exit drain duct 230 at outlet 236 and flow into drain line 161 away from icemaker assembly 200.

Icemaker assembly 200 further includes a defrost heating element 240. Defrost heating element 240 is positioned below mold body 210, e.g., and above bottom wall 234 of drain duct 230, along a vertical direction V. Defrost heating element 240 may also be positioned within drain duct 230, e.g., within drain cavity 232, below mold body 210. Defrost heating element 240 is spaced from mold body 210. Thus, while defrost heating element 240 may be positioned directly adjacent and face mold body 210, defrost heating element 240 does not directly conduct heat to mold body 210. Rather, defrost heating element 240 is operable to melt frost on mold body with radiant heat from defrost heating element 240. Radiant heat from defrost heating element 240 may assist with, e.g., completely, melting frost build up within icemaking chamber 153 and/or on mold body 210 and the melt water may be removed from icemaking chamber 153 via drain duct 230. Because the frost melts from the outside mold body 210 and does not rely on conduction, the melting of frost may be more complete than relying upon a heating element in contact with mold body 210 to defrost icemaking assembly 200.

Defrost heating element 240 may be spaced from other components of icemaking assembly 200 by a suitable distance. For example, defrost heating element 240 may be spaced from a bottom surface 218 of mold body 210 by no less than two centimeters (2 cm.). As another example, defrost heating element 240 may be spaced from a top surface of (e.g., bottom wall 234) drain duct 230 by no less than two centimeters (2 cm.). Such spacing may advantageously facilitate defrosting of mold body 210 and other components of icemaker assembly 200 via radiant heat from defrost heating element 240 while avoiding excessive heat transfer to such components.

In certain example embodiments, defrost heating element 240 may be activated on each ice harvest. Such operation advantageously assists with ensuring complete melting of frost build up on icemaking assembly 200 and/or within icemaking chamber 153. However, it will be understood that defrost heating element 240 may activated at other suitable intervals. For example, defrost heating element 240 may be activated every other ice harvest or at a predefined time interval to defrost icemaking assembly 200 and/or icemaking chamber 153.

Defrost heating element 240 may be mounted to drain duct 230 in certain example embodiments. For example, a plurality of posts 260 may be mounted to drain duct 230. Posts 260 may extend upwardly from drain duct 230, and defrost heating element 240 may be mounted on posts 260, e.g., at distal ends of posts 260. Posts 260 may be constructed of or with an insulator material, such as a ceramic. Thus, the material of posts 260 may be selected to advantageously limit conductive heat transfer from defrost heating element 240 to drain duct 230.

In certain example embodiments, icemaker assembly 200 includes a harvest heating element 250. Harvest heating element 250 may be directly attached to mold body 210. Thus, at least a portion of harvest heating element 250 may be positioned on and contact mold body 210. For example, harvest heating element 250 may be attached to mold body 210 at bottom portion 214 of mold body 210, and the top of harvest heating element 250 may contact bottom portion 214 of mold body 210. Moreover, cavities 212 may be open and face upwardly at top portion 216 of mold body 210, and harvest heating element 250 may be clipped, soldered, adhered, fastened, etc. to mold body 210 opposite cavities 212 at bottom portion 214 of mold body 210.

Harvest heating element 250 may be operable to partially melt ice cubes within cavities 212 in mold body 210. For example, conductive heat transfer from harvest heating element 250 to mold body 210 may assist with partially melting ice cubes within cavities 212 to assist removal of ice cubes from cavities 212. Thus, harvest heating element 250 may be activated on each ice harvest. Defrost heating element 240 may be used in conjunction with harvest heating element 250 to defrost mold body 210. However, it will be understood that icemaker assembly 200 need not include harvest heating element 250. Thus, in certain example embodiments, defrost heating element 240 may both defrost mold body 210 and partially melt ice cubes within cavities 212 in mold body 210 to assist with harvesting the ice cubes in cavities 212.

Defrost heating element 240 and/or harvest heating element 250 may each be a resistance heating element, such as a U-shaped resistance heating element. Thus, e.g., defrost heating element 240 and/or harvest heating element 250 may increase in temperature in response to an electrical voltage applied across terminals of the heating elements. Moreover, defrost heating element 240 and/or harvest heating element 250 may increase in temperature by resisting electrical current flow through the heating elements.

Icemaker assembly 200 may also include an ice bin 270, such as ice bucket 159, and a heat shield 280. Ice bin 270 may be disposed below drain duct 230, and ice cubes from mold body 210 may harvested to ice bin 270. An auger may be disposed within ice bin 270. Heat shield 280 may be mounted to drain duct 230 and disposed between defrost heating element 240 and ice bin 270. Heat shield 280 may limit heat transfer from defrost heating element 240 to ice cubes within ice bin 270. For example, heat shield 280 may assist with dissipating, reflecting, and/or absorbing heat from defrost heating element 240. Heat shield 280 may be a metal sheet or a ceramic panel in certain example embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance, comprising:

a cabinet; and an icemaker assembly disposed within the cabinet, the icemaker assembly comprising a mold body defining a plurality of cavities;

a working fluid line directly attached to the mold body such that at least a portion of the working fluid line contacts the mold body;

a drain duct disposed below the mold body;

a defrost heating element positioned below the mold body and within the drain duct, the defrost heating element spaced from the mold body, the defrost heating element operable to melt frost on the mold body with radiant heat from the defrost heating element; and a plurality of posts mounted to the drain duct, the plurality of posts extending upwardly from the drain duct, the defrost heating element mounted on the plurality of posts.

2. The appliance of claim 1, wherein the icemaker assembly further comprises a harvest heating element directly attached to the mold body such that at least a portion of the harvest heating element contacts the mold body, the harvest heating element operable to partially melt ice cubes within the plurality of cavities in the mold body with conductive heat from the harvest heating element.

3. The appliance of claim 2, wherein the harvest heating element is a resistance heating element clipped to the mold body at a bottom portion of the mold body, and the working fluid line is clipped to the mold body at the bottom portion of the mold body.

4. The appliance of claim 1, wherein the icemaker assembly is disposed within an icemaking compartment of the cabinet, the icemaking compartment spaced from a freezer chamber of the cabinet.

5. The appliance of claim 1, wherein the plurality of posts comprises a plurality of ceramic insulator posts.

6. The appliance of claim 1, wherein the icemaker assembly further comprises an ice bin and a heat shield, the ice bin disposed below the drain duct, the heat shield mounted to the drain duct and disposed between the defrost heating element and the ice bin.

7. The appliance of claim 1, wherein the defrost heating element is spaced from a bottom surface of the mold body by no less than two centimeters.

8. The appliance of claim 7, wherein the defrost heating element is spaced from a top surface of the drain duct by no less than two centimeters.

9. The appliance of claim 1, wherein the defrost heating element is a U-shaped resistance heating element.

10. An icemaker assembly, comprising:

a mold body defining a plurality of cavities;

a working fluid line directly attached to the mold body such that at least a portion of the working fluid line contacts the mold body;

a drain duct disposed below the mold body; and a defrost heating element positioned below the mold body and within the drain duct, the defrost heating element spaced from the mold body, the defrost heating element operable to melt frost on the mold body with radiant heat from the defrost heating element, wherein the defrost heating element is spaced from a bottom surface of the mold body by no less than two centimeters, and the defrost heating element is spaced from a top surface of the drain duct by no less than two centimeters.

11. The icemaker assembly of claim 10, further comprising a harvest heating element directly attached to the mold body such that at least a portion of the harvest heating element contacts the mold body, the harvest heating element operable to partially melt ice cubes within the plurality of cavities in the mold body with conductive heat from the harvest heating element.

12. The icemaker assembly of claim 11, wherein the harvest heating element is a resistance heating element clipped to the mold body at a bottom portion of the mold body.

13. The icemaker assembly of claim 11, wherein the working fluid line is clipped to the mold body at a bottom portion of the mold body.

14. The icemaker assembly of claim 10, further comprising a plurality of posts mounted to the drain duct, the plurality of posts extending upwardly from the drain duct, the defrost heating element mounted on the plurality of posts.

15. The icemaker assembly of claim 14, wherein the plurality of posts comprises a plurality of ceramic insulator posts.

16. The icemaker assembly of claim 10, further comprising an ice bin and a heat shield, the ice bin disposed below the drain duct, the heat shield mounted to the drain duct and disposed between the defrost heating element and the ice bin.

17. The icemaker assembly of claim 10, wherein the defrost heating element is a U-shaped resistance heating element.

* * * * *